US011828142B1

(12) United States Patent
Godfrey et al.

(10) Patent No.: US 11,828,142 B1
(45) Date of Patent: Nov. 28, 2023

(54) SYSTEM AND METHOD FOR HYDRAULICALLY EXPANDING A LINER HANGER

(71) Applicant: Enventure Global Technology, Inc., Houston, TX (US)

(72) Inventors: Matthew Mark Godfrey, Katy, TX (US); Greg Noel, Katy, TX (US)

(73) Assignee: Enventure Global Technology, Inc., Houston, TX (US)

( * ) Notice: Subject to any disclaimer, the term of this patent is extended or adjusted under 35 U.S.C. 154(b) by 0 days.

(21) Appl. No.: 17/971,382

(22) Filed: Oct. 21, 2022

(51) Int. Cl.
*E21B 43/10* (2006.01)

(52) U.S. Cl.
CPC ..... *E21B 43/105* (2013.01); *E21B 43/106* (2013.01)

(58) Field of Classification Search
CPC ..... E21B 43/105; E21B 43/106
See application file for complete search history.

(56) References Cited

U.S. PATENT DOCUMENTS

| | | | | |
|---|---|---|---|---|
| 9,702,229 | B2 * | 7/2017 | Zhou | E21B 43/106 |
| 11,352,858 | B2 | 6/2022 | Connor et al. | |
| 2018/0179832 | A1 * | 6/2018 | Yee | E21B 43/105 |
| 2022/0090457 | A1 * | 3/2022 | Tanguy | E21B 23/0413 |

FOREIGN PATENT DOCUMENTS

WO 2023009118 A1 2/2023

* cited by examiner

*Primary Examiner* — D. Andrews
(74) *Attorney, Agent, or Firm* — Jonathan Pierce; Pierre Campanac; Porter Hedges LLP

(57) ABSTRACT

In a first scenario, nested darts provide pressure isolation between a space inside a liner assembly below an expansion cone and a well annulus. Increased pressure in this space can be used to push the expansion cone upward and assist the bottom-up expansion of a liner hanger provided at the top of the liner assembly. In a second scenario, an obstruction lands on a seat provided in a seat assembly. Pressure in a space located between the expansion cone and the seat assembly is increased such that an upward force acts on the expansion cone to expand the liner hanger. The second scenario may be utilized by itself. Alternatively, the second scenario may be utilized as a contingency method if the first scenario has failed.

14 Claims, 3 Drawing Sheets

SYSTEM AND METHOD FOR HYDRAULICALLY EXPANDING A LINER HANGER

BACKGROUND

The disclosure relates to systems and methods for deploying and setting a liner assembly in a well. More particularly, the disclosure relates to systems and methods for anchoring a liner hanger by expanding the liner hanger using an expansion cone that moves through the liner hanger, at least in part under the effect of hydraulic pressure.

A known example of deployment and setting of a liner assembly in a wellbore utilizes a bottom-up expansion to anchor a liner hanger. In this example, the liner hanger has a dog-bone shape that includes a constricted middle section and upper and lower enlarged sections. The middle section includes a plurality of outer seals. The liner is attached to the lower enlarged section of the liner hanger. An expansion tool having an expansion cone is attached to the bottom of a drill pipe. During the deployment of the liner assembly, the expansion cone is located near the bottom of the liner hanger, in the lower enlarged section. A shoulder between the lower enlarged section and the middle section rests on the face of the expansion cone so that the expansion tool and the drill pipe carry the weight of the liner assembly. The expansion is initiated by pumping a drill-pipe wiper dart into the drill pipe. The drill-pipe wiper dart typically follows the cement column. This drill-pipe wiper dart lands and nests in a liner wiper dart near the lower end of the expansion tool. Increased pressure causes the liner wiper dart to deploy, wipe the liner, and land in the shoe of the liner. These nested darts then seal the shoe of the liner, and continued pumping into the sealed liner creates, in turn, a pressure increase in the liner. The pressure increase pushes a cup seal and/or the expansion cone upward. Bottom-up expansion is used for anchoring the liner hanger to a base casing by expanding the middle section of the liner hanger using the movement of the expansion cone through the liner hanger. When pressed against the base casing because of the expansion of the middle section, the plurality of outer seals anchor the liner hanger to the base casing and provide a seal between the liner hanger and the base casing.

In some cases, the drill-pipe wiper dart and/or the liner wiper dart may fail to seal the shoe of the liner, or expansion cannot be completed due to a leak in the liner. In these cases, the operator may have no option left to complete the expansion of the liner hanger. In addition, in cases where the expansion cone is solid, the operator may have no option left to retrieve the expansion cone from the liner hanger and pull the drill pipe and the expansion tool out of the well. This lack of options presents a high risk when deploying expandable liner hangers.

There is a continuing need in the art for systems and methods for anchoring a liner hanger to a base casing by expanding the liner hanger using an expansion cone that moves under the effect of hydraulic pressure through the liner hanger.

SUMMARY

The disclosure describes a system for setting a liner assembly in a well and a method of setting the liner assembly in the well.

A pup joint may be provided. The pup joint may have an inner shoulder and an inner recessed profile.

An expansion tool may be provided. The expansion tool may have a through-bore and may include an expansion cone. The expansion tool may include a mandrel. The expansion cone may be located around the mandrel.

A seat assembly may be provided. The seat assembly may include a housing. The housing may have an outer surface. The seat assembly may include an outwardly biased protrusion. The outwardly biased protrusion may be axially and rotationally coupled to the outer surface of the housing. The seat assembly may include a first seal positioned around the outer surface of the housing. The seat assembly may include a second seal positioned around the outer surface of the housing. The seat assembly may include an inner shoulder positioned inside a tube formed in the housing. The seat assembly may include a sleeve positioned inside the tube formed in the housing. A seat may be provided inside a tube formed in the sleeve. A sleeve retainer may hold the sleeve to the housing. The housing and the sleeve may each include a lateral port. When the sleeve is attached to the housing with the sleeve retainer, the lateral port included in the housing and the lateral port included in the sleeve may cooperate to provide fluid communication between the tube formed in the sleeve and a space outside the external surface of the housing.

The housing of the seat assembly may be joined to the expansion tool. For example, the housing of the seat assembly and the mandrel may be inserted into the collar at least partially. The seat assembly may be held to the expansion tool with a seat assembly retainer that may be mounted in the collar. A space between the housing and the through-bore of the expansion tool may be sealed with the first seal when the housing is joined to the expansion tool. A space between the housing of the seat assembly and an inner surface of the pup joint may be sealed with the second seal when the seat assembly is inserted into the pup joint. One end of the pup joint may be connected to a liner hanger, and another opposite end of the pup joint may be connected to the liner. The liner hanger, the pup joint, the liner, the expansion tool, and the seat assembly may be lowered into the well with a drill pipe.

A liner wiper dart attached to the seat assembly may be released following a cement column. Then, an obstruction may be pumped with fluid into the through-bore of the expansion tool and the through-bore of the seat assembly. The obstruction may land on the seat of the seat assembly. By increasing the pressure in the fluid above a threshold, the sleeve retainer may release the sleeve from the housing. The sleeve may slide inside the tube formed in the housing. The sleeve may abut the inner shoulder of the housing after being released from the housing. The fluid communication between the tube formed in the sleeve and the space outside the external surface of the housing may be sealed when the sleeve abuts the inner shoulder of the housing. Then, by increasing pressure in the fluid above another higher threshold, the seat assembly retainer may release the seat assembly from the expansion tool. The seat assembly may slide in a portion of the pup joint. The seat assembly may abut the inner shoulder of the pup joint after being released from the expansion tool. The outwardly biased protrusion of the seat assembly may engage with the inner recessed profile of the pup joint. The outwardly biased protrusion of the seat assembly may lock in the inner recessed profile of the pup joint after the housing abuts the inner shoulder of the pup joint.

The liner hanger may be expanded with the expansion cone, at least in part under the effect of hydraulic pressure.

BRIEF DESCRIPTION OF THE DRAWINGS

For a more detailed description of the embodiments of the present disclosure, reference will now be made to the accompanying drawings, wherein.

Figure 1:
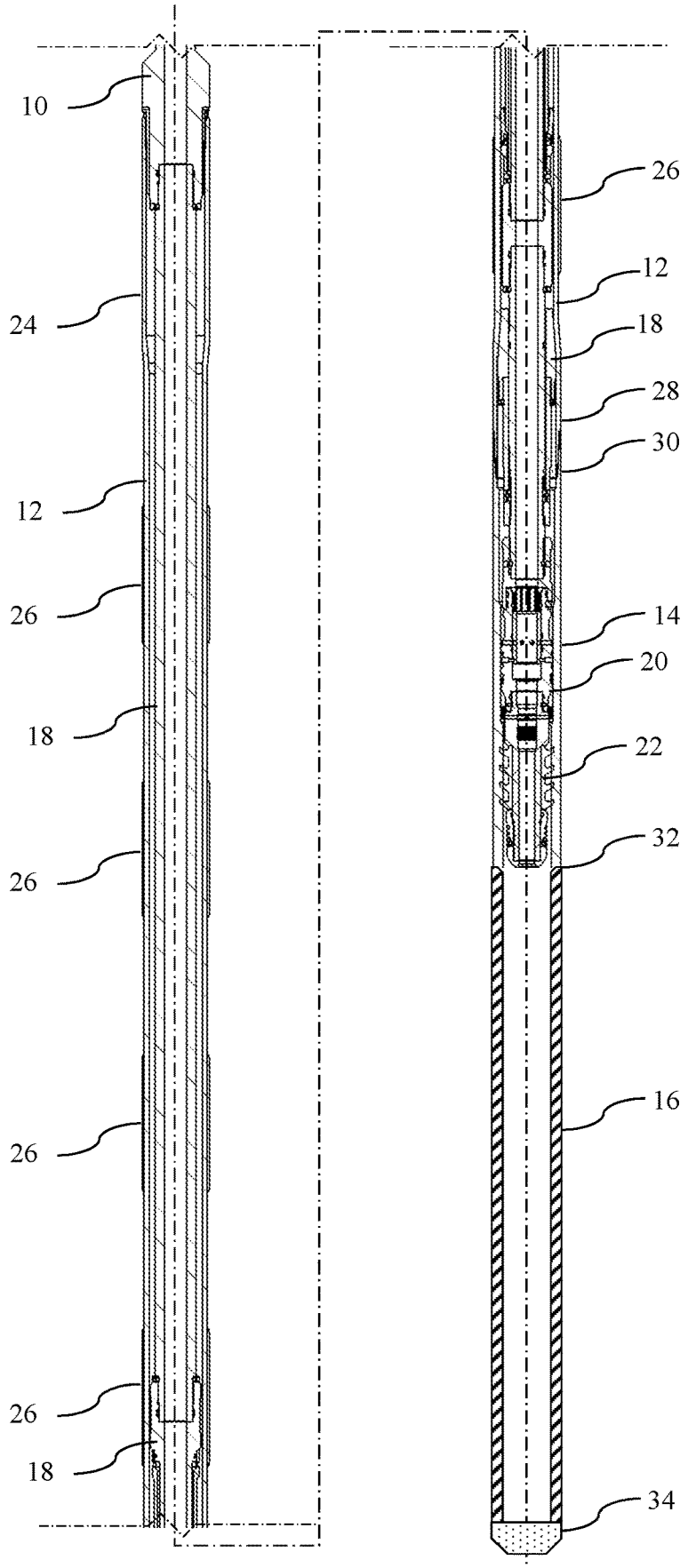
FIG. 1 is a sectional view of a system for deploying and setting a liner assembly in a well.

As is customary, the Figures may not be to scale for the sake of simplicity and clarity.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

A liner assembly typically comprises a liner hanger (sometimes referred to as a liner anchor), a pup joint connected below the liner hanger, a liner connected below the pup joint, and a liner shoe connected below the liner. The liner hanger is preferably dog-bone shaped and includes outer seals, for example, made of elastomer, in the constricted middle portion.

In order to deploy the liner assembly in a well, an expansion tool is typically connected below a drill pipe. A seat assembly is connected below the expansion tool. A liner wiper dart is connected below the seat assembly. The expansion tool is introduced in the liner hanger so that an expansion cone is located in the lower enlarged portion of the liner hanger. The seat assembly is located in the pup joint. The expansion cone can carry the weight of the liner on the cone face.

In order to set the liner assembly in a well, bottom-up expansion is utilized to expand the top of the liner assembly (i.e., the constricted portion of the liner hanger) into the previous base casing. The expanded liner hanger functions as both a liner anchor and a top packer. This technology differs from conventional liner hanger technology, which involves slips. Also, this technology differs from conventional liner expansion, where the entirety of the liner is expanded.

In a first preferred scenario, the setting of the liner assembly is performed by pumping a drill pipe wiper dart into the expansion tool. The drill pipe wiper dart typically follows the cement column. This drill pipe wiper dart lands in the liner wiper dart and nests with it. These nested darts then deploy to wipe the liner and land in the liner shoe. After landing in the liner shoe, these nested darts provide pressure isolation between a space inside the liner assembly below the expansion cone and the annulus between the drill pipe/liner assembly and the wall of the well. Thus, pumping further fluid through the drill pipe into the space inside of the liner assembly below the expansion cone increases the pressure inside the space inside the liner assembly. This increased pressure can be used to push the expansion cone upward and perform the bottom-up expansion of the constricted portion of the liner hanger at the top of the liner assembly. Pulling on the drill pipe can optionally be used to complement the increased pressure to move the expansion cone upward. Once the expansion is completed, the seat assembly and the expansion tool are retrieved from the well at the end of the drill pipe. Then, the liner shoe and dart equipment at the bottom of the liner may be milled up in a subsequent trip.

In a second preferred setting scenario, a drill pipe wiper dart is similarly pumped into the expansion tool, and it also lands in the liner wiper dart and nests with it. These nested darts then deploy to wipe the liner and land in the liner shoe. However, the setting of the liner assembly is performed by dropping a ball or other deployable obstruction into the drill pipe and pumping it down with fluid. The ball lands on a seat provided in the seat assembly. Pressure is increased behind the ball to release the seat assembly from the expansion tool. After the seat assembly is released, it self-locks into the pup joint. It is preferable that the seat assembly is locked in both the axial direction and the radial direction to facilitate its future milling. Pressure in a space located between the expansion cone and the seat assembly is then further increased such that a downward force is transferred to the liner and an upward force acts on the expansion cone to expand the constricted portion of the liner hanger. The operator can use a combination of overpull on the drill pipe and hydraulic pressure to expand and clad the liner hanger onto the base casing. In this scenario, the entire space inside the liner below the seat assembly is not pressurized in order to expand the liner hanger. Once the expansion is completed, the expansion tool is retrieved at the end of the drill pipe, and the seat assembly and the ball are left downhole in the pup joint. Preferably, the seat assembly is manufactured from a millable material such as aluminum or composite. As such, the seat assembly can be milled up in a subsequent trip, along with the liner shoe and dart equipment at the bottom of the liner.

The second scenario may be utilized by itself, for example, when an operator is unwilling to apply expansion pressure to the entire length of the liner. Alternatively, the second scenario may be utilized after the operator has attempted the first scenario and is unable to apply expansion pressure to the entire length of the liner. For example, the second scenario may be utilized as a contingency method if there is a leak in the liner below the seat assembly or if the nested darts fail to land or seal in the liner shoe to provide pressure isolation. Indeed, such a contingency method of expansion is typically desirable to allow the operator to initiate or continue expansion and retrieve the expansion tool.

Referring to FIG. 1, a liner assembly includes a liner hanger 12, a pup joint 14, a liner 16, and a shoe 34.

The liner hanger 12 has an upper enlarged section 24, a lower enlarged section 28, and a constricted middle section 26 in between. The constricted middle section is provided with elastomeric outer seals that can be used to anchor the liner hanger 12 to a base casing and provide a seal between the liner hanger 12 and the base casing after the constricted middle section has been expanded.

The pup joint 14 includes an end 30 connected (e.g., threaded) to the lower enlarged section 28 of the liner hanger 12 and another end 32 connected (e.g., threaded) to the liner 16.

The shoe 34 is connected below the liner 16.

A string assembly includes a drill pipe 10, an expansion tool 18, a seat assembly 20, and a liner wiper dart 22. The expansion tool 18 is attached at the lower end of the drill pipe 10. The seat assembly 20 is joined and held to a lower end of the expansion tool 18. The liner wiper dart 22 is releasably attached to the seat assembly.

Figure 2:
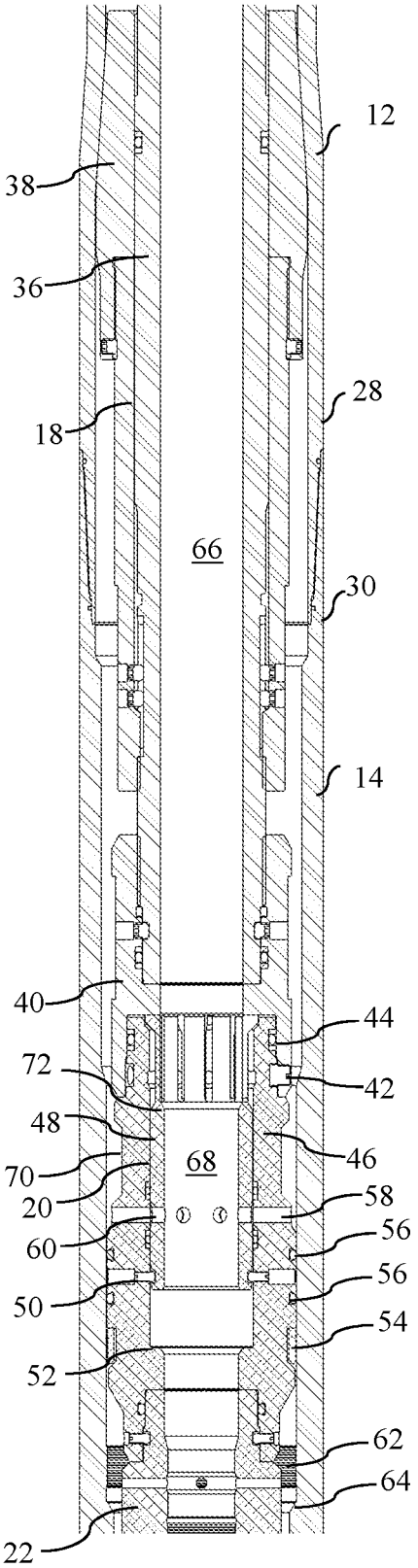
FIG. 2 is a sectional view of a portion of the system shown in FIG. 1.

Referring to FIG. 2, the expansion tool 18 includes a mandrel 36, a collar 40, and an expansion cone 38. The collar 40 is attached to the mandrel 36. The expansion tool 18 has a through-bore 66, which is formed in part in the collar 40.

The seat assembly 20 is inserted into the through-bore 66. One or more shear pins 42 hold the seat assembly 20 to the expansion tool 18.

The seat assembly 20 includes a housing 46 having a tube formed in it and a shoulder 52 located in the tube, a sleeve 48, a pair of O-rings 56, an O-ring 44, a ratchet split ring 54, and one or more shear pins 50. After the shear pins 50 have sheared off, the sleeve 48 can slide inside the tube formed in the housing 46 until it abuts the shoulder 52. A seat 72 of the seat assembly 20 is located in a tube formed in the sleeve 48, in the through-bore 68.

The O-ring 44 provides a seal between the housing 46 and the collar 40. Each of the pair of O-rings 56 provides a seal between the housing 46 and an inner surface of the pup joint 14.

The housing 46 includes one or more lateral ports 58. The sleeve 48 includes one or more corresponding lateral ports 60. The lateral ports 58 and the lateral ports 60 are located below the seat 72, so that after an obstruction has landed on the seat 72, it hinders or prevent fluid pumped at surface into the trough-bore 66 from flowing into the lateral ports 58 and the lateral ports 60. In the position of the sleeve 48 illustrated in FIG. 2, the lateral ports 58 are aligned with the lateral ports 60 so that a fluid communication between the tube formed in the sleeve 48 and a space outside an outer surface 70 is established.

The inner surface of the pup joint 14 includes a shoulder 64 and helical grooves 62. The helical grooves 62 form a fine buttress inner thread. After the shear pins 42 have sheared off, the seat assembly 20 can slide inside the pup joint 14 until it abuts the shoulder 64. When the seat assembly 20 abuts the shoulder 64, the ratchet split ring 54 engages and locks with the helical grooves 62.

Figure 3:
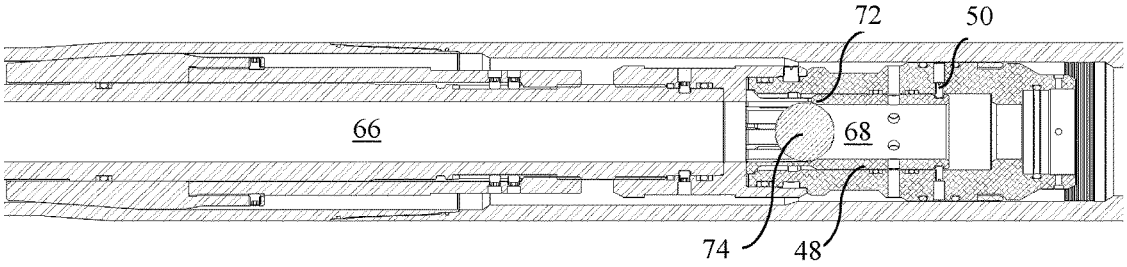
FIGS. 3-5 illustrate the portion shown in FIG. 2 in a sequence of steps of a method for deploying and setting a liner assembly in a well.

Referring to FIG. 3, during the lowering of the liner assembly and the string assembly into the well, the lateral ports 58 are aligned with the lateral ports 60 so that the fluid communication between the tube formed in the sleeve 48 and the space outside an outer surface 70 is established. A purpose of having the fluid communication between the tube formed in the sleeve 48 and the space outside an outer surface 70 open is to allow the pressure in a cavity created between the expansion tool 18/seat assembly 20, and the liner hanger 12/pup joint 14 to equilibrate to wellbore pressure and not trap hydrostatic or atmospheric pressure. Once the liner assembly is located at the desired position in the well, a ball 74 is pumped with fluid inside the through-bore 66 and the through-bore 68 until it lands on the seat 72.

When further fluid is pumped, the pressure in the though-bore 66 increases. The fluid pressure generates a force on the ball 74. This force is transmitted by the sleeve 48 to the shear pins 50. When the fluid pressure is sufficiently large, the shear pins 50 fail.

Figure 4:
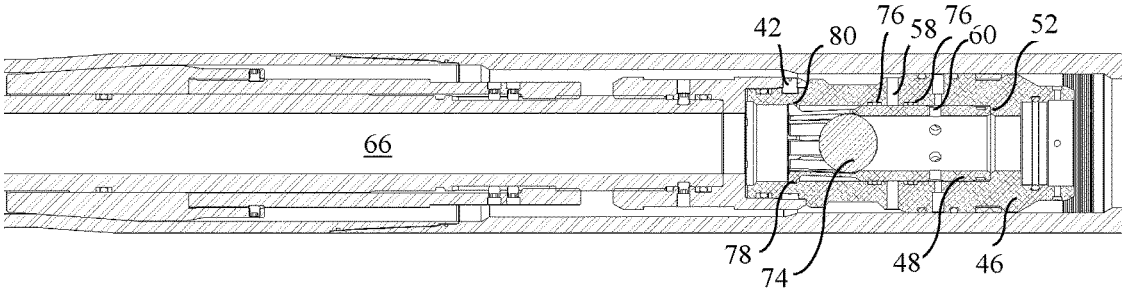

Referring to FIG. 4, the sleeve 48 has slid inside the tube formed in the housing 46 and abuts the shoulder 52. In the position of the sleeve 48 illustrated in FIG. 4, the lateral ports 58 are sealed from the lateral ports 60 by O-rings 76 located around the lateral port 58. A purpose of the O-rings 76 and shifting the lateral port 60 outside of the area sealed by the O-rings 76 is to hinder or prevent fluid flow and/or pressure from circumventing the ball 74 when the ball 74 has landed on the seat 72 both before and after the housing 46 is released from the expansion tool 12. Finger collets 78 are contracted so that the ball 74 is captured in the finger collets 78. The finger collets 78 engage a groove 80 located in the tube formed in the housing 46 so that the sleeve 48 is held in place in the housing 46.

When fluid is further pumped, the pressure in the though-bore 66 further increases. The fluid pressure generates a force on the ball 74. This force is transmitted by the sleeve 48 and the housing 46 to the shear pins 42. When the fluid pressure is sufficiently large, the shear pins 42 fail.

Figure 5:
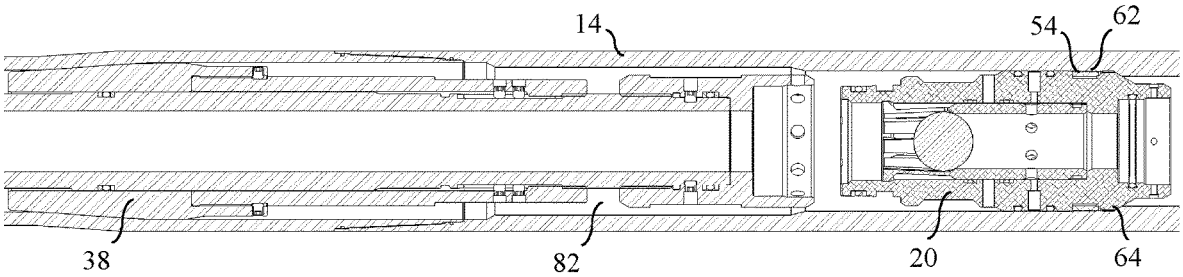

Referring to FIG. 5, the seat assembly 20 has slid inside the pup joint 14 and abuts the shoulder 64. The ratchet split ring 54 engages and locks with the helical grooves 62.

When fluid is further pumped, the pressure in a space 82 located between the expansion cone 38 and the seat assembly 20 increases such that an upward force acts on the expansion cone 38 to expand the liner hanger 12 (shown in FIG. 1).

Additionally, the disclosure also contemplates at least the following embodiments:

Embodiment 1

Embodiment 1 is a system for setting a liner assembly in a well.

The system comprises a pup joint, an expansion tool, and a seat assembly.

The expansion tool has a through-bore that is configured so that an obstruction, such as a ball, can be pumped with fluid into the through-bore of the expansion tool. The expansion tool includes an expansion cone, such as an expandable/contractible cone, configured to expand a liner hanger.

The seat assembly includes a housing shaped to be joined to the expansion tool. Preferably, the housing is sized to be at least partially inserted into a through-bore of the expansion tool. However, the housing may be sized to at least partially receive the expansion tool. The seat assembly also has a through-bore that is configured so that the obstruction can be pumped with fluid into the through-bore of the seat assembly. The seat assembly has a seat on which the obstruction can land. The seat is located in the through-bore of the seat assembly. The seat assembly includes an outwardly biased protrusion that is axially and rotationally coupled to an outer surface of the housing. Preferably, the outwardly biased protrusion includes a ratchet split ring that is coupled to the housing using one or more tenons and/or mortises or an equivalent thereof. However, the outwardly biased protrusion may include one or more spring-loaded dogs or splines or an equivalent thereof.

A seat assembly retainer, such as one or more shear pins, holds the seat assembly to the expansion tool. The seat assembly retainer is configured to release the seat assembly from the expansion tool upon the pressure in the fluid exceeding a first threshold, such as by shearing off the one or more shear pins.

The pup joint is configured to be connected at one end to the liner hanger and at another opposite end to the liner, such as with threaded pin/box ends. The seat assembly is capable of sliding in a portion of the pup joint when the outwardly biased protrusion is collapsed, and the seat assembly retainer has released the seat assembly. The pup joint has an inner shoulder on which the seat assembly can abut. The pup joint also has an inner recessed profile. Preferably, the inner recessed profile includes helical grooves forming a fine buttress inner thread capable of interlocking with a ratchet split ring or an equivalent thereof. However, the inner recessed profile may include a groove or cavities distributed around an inner circumference of the pup joint and capable of locking with one or more dogs or splines, or an equivalent thereof. The outwardly biased protrusion is configured to engage and lock to the inner recessed profile of the pup joint when the housing abuts the inner shoulder of the pup joint.

Embodiment 2

Embodiment 2 is a system as described in embodiment 1 wherein the seat assembly further comprises a first seal, such as one or more O-rings, positioned around the outer surface of the housing and configured to seal a space between the housing and the expansion tool when the housing is joined to the through-bore of the expansion tool. Preferably, the first seal is located in a groove formed on the outer surface of the housing. However, the first seal may be located in a groove formed in the through-bore of the expansion tool. Preferably, the first seal seals the space between the housing and the through-bore of the expansion tool when the housing is at least partially inserted into the through-bore of the expansion tool. However, the first seal may seal the space between the housing and the through-bore of the expansion tool when the expansion tool is at least partially received in the housing.

After the obstruction is pumped with fluid into the through-bore of the seat assembly, it lands on the seat. Pressure in the fluid generates forces applied on the obstruction, the housing of the seat assembly, and the first seal that tend to separate the seat assembly from the expansion tool.

Embodiment 3

Embodiment 2 is a system as described in embodiment 1 or 2 wherein the seat assembly further comprises a second seal, such as one or more O-rings, positioned around the outer surface of the housing and configured to seal a space between the housing and an inner surface of the pup joint. Preferably, the second seal is located in a groove formed on the outer surface of the housing. However, the second seal may be located in a groove formed on the inner surface of the pup joint.

After the obstruction is pumped with fluid into the through-bore of the seat assembly, it lands on the seat. Pressure in the fluid generates forces applied on the obstruction, the housing of the seat assembly, and the second seal that tend to cause the seat assembly to slide in the portion of the pup joint toward the inner shoulder of the pup joint.

Embodiment 4

Embodiment 4 is a system as described in any of embodiments 1 to 3, wherein the seat assembly further comprises an inner shoulder and a sleeve, both positioned inside a tube formed in the housing. The seat of the seat assembly is provided inside a tube formed in the sleeve. A sleeve retainer, such as one or more shear pins, attaches the sleeve to the housing.

The housing and the sleeve each include at least one lateral port, which is preferably located below the seat of the seat assembly, toward the bottom of pup joint. When the sleeve is attached to the housing with the sleeve retainer, the lateral port included in the housing and the lateral port included in the sleeve cooperate to provide fluid communication between the tube formed in the sleeve and a space outside the external surface of the housing. As such, fluid can flow through the fluid communication, thus alleviating the risk of hydrostatic or atmospheric pressure becoming trapped within a space located outside the expansion tool/seat assembly and inside the liner hanger/pup joint. Otherwise, such a pressure trap may cause the pup joint or liner hanger to experience an excessive differential pressure which could lead to collapse failure.

After the obstruction is pumped with fluid into the through-bore of the seat assembly, it lands on the seat. Pressure in the fluid generates forces applied on the obstruction and the sleeve that tends to cause the sleeve to slide toward the inner shoulder of the housing. The sleeve retainer is configured to release the sleeve from the housing upon the pressure in the fluid exceeding a second threshold, such as by shearing off the one or more shear pins.

The sleeve is capable of sliding inside the tube formed in the housing and abutting the inner shoulder of the housing after being released from the housing. When the sleeve abuts the inner shoulder of the housing, the fluid communication between the tube formed in the sleeve and the space outside the external surface of the housing is sealed. For example, two or more seals, such as O-rings, may seal an interval of space between the sleeve and the tube formed in the housing. The lateral port included in the housing may be located in the sealed interval. In a first position of the sleeve, the lateral port included in the sleeve may also be located in the sealed interval. In a second position of the sleeve, the lateral port included in the sleeve may be located outside the sealed interval. As such, after the sleeve has shifted to the second position, fluid is further pumped into the through-bore of the seat assembly, and the seat assembly is just released from the expansion tool, the fluid may not bypass around the obstruction and the top of the body of the seat assembly. As such, pressure in the fluid trapped by the obstruction may not decrease significantly, thus facilitating the separation of the seat assembly from the expansion tool.

Embodiment 5

Embodiment 5 is a system as described in embodiment 4 wherein the second threshold is lower than the first threshold. As such, as the pressure in the fluid pumped into the through-bore of the seat assembly gradually increases, the sleeve retainer releases the sleeve before the seat assembly retainer releases the seat assembly.

Embodiment 6

Embodiment 6 is a system as described in any of embodiments 1 to 5, wherein the expansion tool further includes a mandrel. The expansion cone is provided around the mandrel. The housing of the seat assembly and the mandrel are sized to be at least partially inserted into the collar. The seat assembly retainer is mounted in the collar. Preferably, the collar is attached to the expansion tool and remains attached to the expansion tool when the seat assembly is released. However, the collar may be attached to the seat assembly and may remain attached to the seat assembly when the seat assembly is released.

Embodiment 7

Embodiment 7 is a system as described in any of embodiments 1 to 6, further comprising a liner wiper dart releasably attached to the seat assembly. The liner wiper dart is capable of engaging and sealing against a liner shoe. The liner wiper dart is capable of receiving and sealing against a drill pipe wiper dart pumped with fluid into the through-bore of the expansion tool and into the through-bore of the seat assembly. As such, the liner wiper dart and the drill pipe wiper dart can cooperate to squeeze cement in an annulus between the liner and the wall of the well.

Embodiment 8

Embodiment 8 is a method of setting a liner assembly in a well. The method comprises the steps of providing a system as described in embodiment 7 and assembling the system. For example, assembling the system may involve joining the housing of the seat assembly to the expansion tool, holding the seat assembly to the expansion tool with the seat assembly retainer, and connecting one end of the pup joint to a liner hanger and another opposite end of the pup joint to the liner.

Then, the method further comprises the steps of lowering the liner hanger, the pup joint, the liner, the expansion tool, and the seat assembly into the well with a drill pipe, pumping the drill pipe wiper dart following a cement column, receiving the drill pipe wiper dart in the liner wiper dart, sealing the drill pipe wiper dart against the liner wiper dart, releasing the liner wiper dart from the seat assembly, and engaging the liner wiper dart with the liner shoe.

Then, the method further comprises the steps of expanding the liner hanger with the expansion cone. In this embodiment, the expansion is performed without pumping an obstruction with fluid into the through-bore of the expansion tool and the through-bore of the seat assembly and without causing the seat assembly retainer to release the seat assembly from the expansion tool. If implement, the fluid communication can facilitate the expansion of the liner hanger by providing a fluid flow path to a space located underneath the cone and can reduce or eliminate the risk of the seat assembly retainer accidentally releasing the seat assembly (e.g., by shearing the one or more shear pins).

Then, the method further comprises retrieving the expansion tool and the seat assembly from the well, leaving the liner hanger, the pup joint, and the liner in the well.

Embodiment 9

Embodiment 9 is a method of setting a liner assembly in a well. The method comprises the steps of providing a system as described in any of embodiments 1 to 7 and assembling the system. For example, assembling the system may involve joining the housing of the seat assembly to the expansion tool, holding the seat assembly to the expansion tool with the seat assembly retainer, and connecting one end of the pup joint to a liner hanger and another opposite end of the pup joint to the liner.

Then, the method further comprises the steps of lowering the liner hanger, the pup joint, the liner, the expansion tool, and the seat assembly into the well with a drill pipe, pumping the drill pipe wiper dart following a cement column, receiving the drill pipe wiper dart in the liner wiper dart, sealing the drill pipe wiper dart against the liner wiper dart, releasing the liner wiper dart from the seat assembly, engaging the liner wiper dart with the liner shoe.

Then, the method further comprises the steps of pumping an obstruction with fluid into the through-bore of the expansion tool and the through-bore of the seat assembly, landing the obstruction on the seat of the seat assembly, causing the seat assembly retainer to release the seat assembly from the expansion tool by increasing pressure in the fluid above a first threshold, causing the seat assembly to slide in a portion of the pup joint, causing the seat assembly to abut the inner shoulder of the pup joint after being released from the expansion tool, engaging the outwardly biased protrusion of the seat assembly with the inner recessed profile of the pup joint, and locking the outwardly biased protrusion of the seat assembly in the inner recessed profile of the pup joint after the housing abuts the inner shoulder of the pup joint.

Then, the method further comprises the steps of expanding the liner hanger with the expansion cone. The method further comprises retrieving the expansion tool, leaving the liner hanger, the pup joint, the liner, the seat assembly, and the obstruction in the well. Optionally, the seat assembly and the obstruction are then at least partially milled. Optionally, the liner shoe is also at least partially milled.

Embodiment 10

Embodiment 10 is a method of setting a liner assembly in a well as described in embodiments 8 or 9, wherein assembling the system further involves inserting the housing of the seat assembly and the mandrel into the collar at least partially.

Embodiment 11

Embodiment 11 is a method of setting a liner assembly in a well as described in embodiments 9 or 10, further comprising causing the sleeve retainer to release the sleeve from the housing of the seat assembly by increasing the pressure in the fluid above a second threshold, causing the sleeve to slide in the tube formed in the housing, causing the sleeve to abut the inner shoulder of the housing after being released from the housing, and sealing the fluid communication between the tube formed in the sleeve and the space outside the external surface of the housing when the sleeve abuts the inner shoulder of the housing.

Optionally, the sleeve includes a finger collet, and the obstruction is captured in the sleeve by contracting the fingers of the collet. Optionally, the sleeve is held in place in the housing by engaging the fingers of the collet with a groove located on the tube formed in the housing.

Embodiment 12

Embodiment 12 is a method of setting a liner assembly in a well, as described in embodiments 11, wherein the second threshold is lower than the first threshold.

The method further comprises gradually increasing the pressure in the fluid pumped into the through-bore of the seat assembly. The release of the sleeve occurs before the release of the seat assembly.

Embodiment 13

Embodiment 13 is a method of setting a liner assembly in a well as described in embodiments 9 or 12, further comprising sealing a space between the housing and the through-bore of the expansion tool with the first seal when the housing is joined to the expansion tool.

Embodiment 14

Embodiment 14 is a method of setting a liner assembly in a well as described in embodiments 9 or 13, further comprising sealing a space between the housing and an inner surface of the pup joint with the second seal.

What is claimed is:

1. A method of setting a liner assembly in a well, comprising:

providing a pup joint having an inner shoulder and an inner recessed profile;

providing an expansion tool having a through-bore and including an expansion cone;

providing a seat assembly, the seat assembly having a through-bore, the through-bore having a seat, the seat assembly including:

a housing having an outer surface; and an outwardly biased protrusion axially and rotationally coupled to the outer surface of the housing;

joining the housing of the seat assembly to the expansion tool;

holding the seat assembly to the expansion tool with a seat assembly retainer;

connecting one end of the pup joint to a liner hanger and another opposite end of the pup joint to the liner;

lowering the liner hanger, the pup joint, the liner, the expansion tool, and the seat assembly into the well with a drill pipe;

pumping an obstruction with fluid into the through-bore of the expansion tool and the through-bore of the seat assembly;

landing the obstruction on the seat of the seat assembly;

causing the seat assembly retainer to release the seat assembly from the expansion tool by increasing pressure in the fluid above a first threshold;

causing the seat assembly to slide in a portion of the pup joint;

causing the seat assembly to abut the inner shoulder of the pup joint after being released from the expansion tool;

engaging the outwardly biased protrusion of the seat assembly with the inner recessed profile of the pup joint;

locking the outwardly biased protrusion of the seat assembly in the inner recessed profile of the pup joint after the housing abuts the inner shoulder of the pup joint; and expanding the liner hanger with the expansion cone.

2. The method of claim 1, wherein the seat assembly further comprises a seal positioned around the outer surface of the housing, the method further comprising sealing a space between the housing and the through-bore of the expansion tool with the seal when the housing is joined to the expansion tool.

3. The method of claim 1, wherein the seat assembly further comprises a seal positioned around the outer surface of the housing, the method further comprising sealing a space between the housing and an inner surface of the pup joint with the seal.

4. The method of claim 1, wherein the seat assembly further comprises an inner shoulder positioned inside a tube formed in the housing, a sleeve positioned inside the tube formed in the housing, wherein the seat of the seat assembly is provided inside a tube formed in the sleeve, and a sleeve retainer holding the sleeve to the housing;

wherein the housing and the sleeve each include a lateral port, wherein the lateral port included in the housing and the lateral port included in the sleeve cooperate to provide fluid communication between the tube formed in the sleeve and a space outside the external surface of the housing when the sleeve is attached to the housing with the sleeve retainer;

the method further comprising causing the sleeve retainer to release the sleeve from the housing by increasing the pressure in the fluid above a second threshold;

causing the sleeve to slide in the tube formed in the housing;

causing the sleeve to abut the inner shoulder of the housing after being released from the housing; and sealing the fluid communication between the tube formed in the sleeve and the space outside the external surface of the housing when the sleeve abuts the inner shoulder of the housing.

5. The method of claim 4, wherein the second threshold is lower than the first threshold.

6. The method of claim 1, wherein the expansion tool further includes a mandrel and a collar, wherein the expansion cone is provided around the mandrel, and wherein the seat assembly retainer is mounted in the collar, the method further comprising inserting the housing of the seat assembly and the mandrel into the collar at least partially.

7. The method of claim 1, further comprising releasing a liner wiper dart attached to the seat assembly before the obstruction is pumped.

8. A system for setting a liner assembly in a well, comprising:

a pup joint having an inner shoulder and an inner recessed profile and configured to be connected at one end to a liner hanger and at another opposite end to the liner;

an expansion tool having a through-bore and including an expansion cone configured to expand the liner hanger;

a seat assembly, the seat assembly having a through-bore, the through-bore having a seat, the seat assembly including:

a housing shaped to be joined to the expansion tool, and having an outer surface; and an outwardly biased protrusion axially and rotationally coupled to the outer surface of the housing; and a seat assembly retainer holding the seat assembly to the expansion tool;

wherein the through-bore of the expansion tool and the through-bore of the seat assembly are configured so that an obstruction can be pumped with fluid into the through-bore of the expansion tool and the through-bore of the seat assembly, and land on the seat of the seat assembly;

wherein the seat assembly retainer is configured to release the seat assembly from the expansion tool upon pressure in the fluid exceeding a first threshold;

wherein the seat assembly is capable of sliding in a portion of the pup joint and abutting the inner shoulder of the pup joint after being released from the expansion tool; and wherein the outwardly biased protrusion is configured to engage and lock to the inner recessed profile of the pup joint when the housing abuts the inner shoulder of the pup joint.

9. The system of claim 8, wherein the seat assembly further comprises a seal positioned around the outer surface of the housing and configured to seal a space between the housing and the through-bore of the expansion tool when the housing is at least partially inserted into the through-bore of the expansion tool.

10. The system of claim 8, wherein the seat assembly further comprises a seal positioned around the outer surface of the housing and configured to seal a space between the housing and an inner surface of the pup joint.

11. The system of claim 8, wherein the seat assembly further comprises:

an inner shoulder positioned inside a tube formed in the housing;

a sleeve positioned inside the tube formed in the housing, wherein the seat of the seat assembly is provided inside a tube formed in the sleeve;

a sleeve retainer attaching the sleeve to the housing;

wherein the housing and the sleeve each include a lateral port, wherein the lateral port included in the housing and the lateral port included in the sleeve cooperate to provide fluid communication between the tube formed in the sleeve and a space outside the external surface of the housing when the sleeve is attached to the housing with the sleeve retainer;

wherein the sleeve retainer is configured to release the sleeve from the housing upon the pressure in the fluid exceeding a second threshold;

wherein the sleeve is capable of sliding in the tube formed in the housing and abutting the inner shoulder of the housing after being released from the housing;

wherein the fluid communication between the tube formed in the sleeve and the space outside the external surface of the housing is sealed when the sleeve abuts the inner shoulder of the housing.

12. The system of claim 11, wherein the second threshold is lower than the first threshold.

13. The system of claim 8, wherein the expansion tool further includes:

a mandrel, wherein the expansion cone is provided around the mandrel; and a collar, wherein the mandrel and the housing of the seat assembly are sized to be at least partially inserted into the collar;

wherein the seat assembly retainer is mounted in the collar.

14. The system of claim 8, further comprising a liner wiper dart releasably attached to the seat assembly.

* * * * *